US005251620A

United States Patent [19]

Boucher et al.

[11] Patent Number: 5,251,620

[45] Date of Patent: Oct. 12, 1993

[54] HEAT MASSAGER

[76] Inventors: Richard L. Boucher; Gerard J. Boucher, both of 8 S. Lisbon St., Lewistown, Me. 04240

[21] Appl. No.: 849,710

[22] Filed: Mar. 9, 1992

[51] Int. Cl.[5] ..... A61H 1/00; A61H 15/00

[52] U.S. Cl. ..... 128/24.3; 128/57

[58] Field of Search ..... 128/57, 25 R, 25 B, 128/44, 60, 61, 62 R, 24.1, 24.3, 57; 297/180, 439

[56] References Cited

U.S. PATENT DOCUMENTS

| | | | |
|---|---|---|---|
| 2,123,765 | 7/1938 | Bromberg | 128/57 |
| 2,219,086 | 10/1940 | Bromberg | 128/57 |
| 2,521,874 | 9/1950 | Runstedler | 128/57 X |
| 2,534,412 | 12/1950 | Burnett et al. | 128/57 X |
| 2,582,686 | 1/1952 | Fabio | 128/57 |
| 2,595,328 | 5/1952 | Bowen | 62/530 |
| 2,765,786 | 10/1956 | Blong | 128/57 X |
| 3,888,241 | 6/1975 | Fischer | 128/57 X |
| 4,167,940 | 9/1979 | Ruf | 128/57 |
| 4,177,803 | 12/1979 | Papistas-Scherer et al. | 128/57 X |
| 4,210,135 | 7/1980 | Deuser | 128/57 |

*Primary Examiner*—Robert A. Hafer
*Assistant Examiner*—Brian E. Hanlon
*Attorney, Agent, or Firm*—Randy W. Lacasse

[57] ABSTRACT

A foot massager in which dual soapstone massaging rollers are maintained at a temperature commensurate with the individual users' particular needs. The rollers are first removed from the foot massager and then heated by any of the following methods: soaking in hot water; sunlight; placed on a stove/range or any other known method of thermal transfer. The rollers are then placed back onto the foot massager unit. The massager unit consists of a wooden base frame which provides both support for the rollers and further provides an upwardly extending slot for encapsulating the rollers allowing both freedom of rotational movement and ease of removal and replacement.

13 Claims, 4 Drawing Sheets

HEAT MASSAGER

BACKGROUND OF THE INVENTION

Foot massagers have been known for quite sometime and can provide many hours of relief and enjoyment from the stresses placed upon the feet. The conventional foot massager can combine both heat and some form of massaging whether it be through vibration or through some form of variably textured surface. Foot massagers often incorporate some form of container for holding water or other liquids. These containers are filled with the desired liquid wherein the individual using the massager soaks the feet therein. An alternate method of providing heat to an individuals feet, providing a form of therapeutic relaxation, is to provide electrically sourced heat in the form of an encapsulated heating coil or coils or hot plate. Examples of prior art foot massagers available today are as follows:

U.S. Pat. No. 4,513,736 to Thurber, which provides for a cushioned massager having a soft enclosure for at least one foot and a vibration source.

U.S. Pat. Nos. 4,513,735; 4,446,855; 4,429,687 all to Friedson et al., provide for an apparatus for treating feet which includes: a tub enclosure for liquid (i.e. water); heat source in the foot rest and water tub and vibrator plate.

U.S. Pat. No. 4,057,053 to Kunz, provides for a soaking bath and vibrating source separate from the bath.

U.S. Pat. Nos. 3,965,495 and 3,942,520 both to McNair, provide for a tub enclosure with a vibrator means and heating source provided for therein.

U.S. Pat. No. 3,854,474 to Carruth provides for a base which imparts an evenly distributed vibration.

Each of the above cited references represents various known foot massagers with differing combinations of heat and massage.

The problem with the prior art devices is that they fail to provide for the combination of a massaging unit and heat source in a single non-electrical portable device.

OBJECTS OF THE INVENTION

It is an object of the instant invention to provide for a single unit which provides for the combination of a textured foot massager incorporating heat therein.

A further object is to provide this unit with the additional ability of not requiring an electrical source for convenience and safety.

A further object is to make this device portable.

A further object is to provide for a device that requires little or no cleanup as the rollers will dry by themselves as opposed to prior art tub enclosures.

A further object is to provide for a device that requires little or no maintenance as there are no electrical parts to replace upon failure and very few moving parts.

A further object is to provide for a traditionally styled unit as the entire unit is constructed of wood and stone although it is not restricted to these materials.

DETAILED DESCRIPTION OF INVENTION

Figure 1:
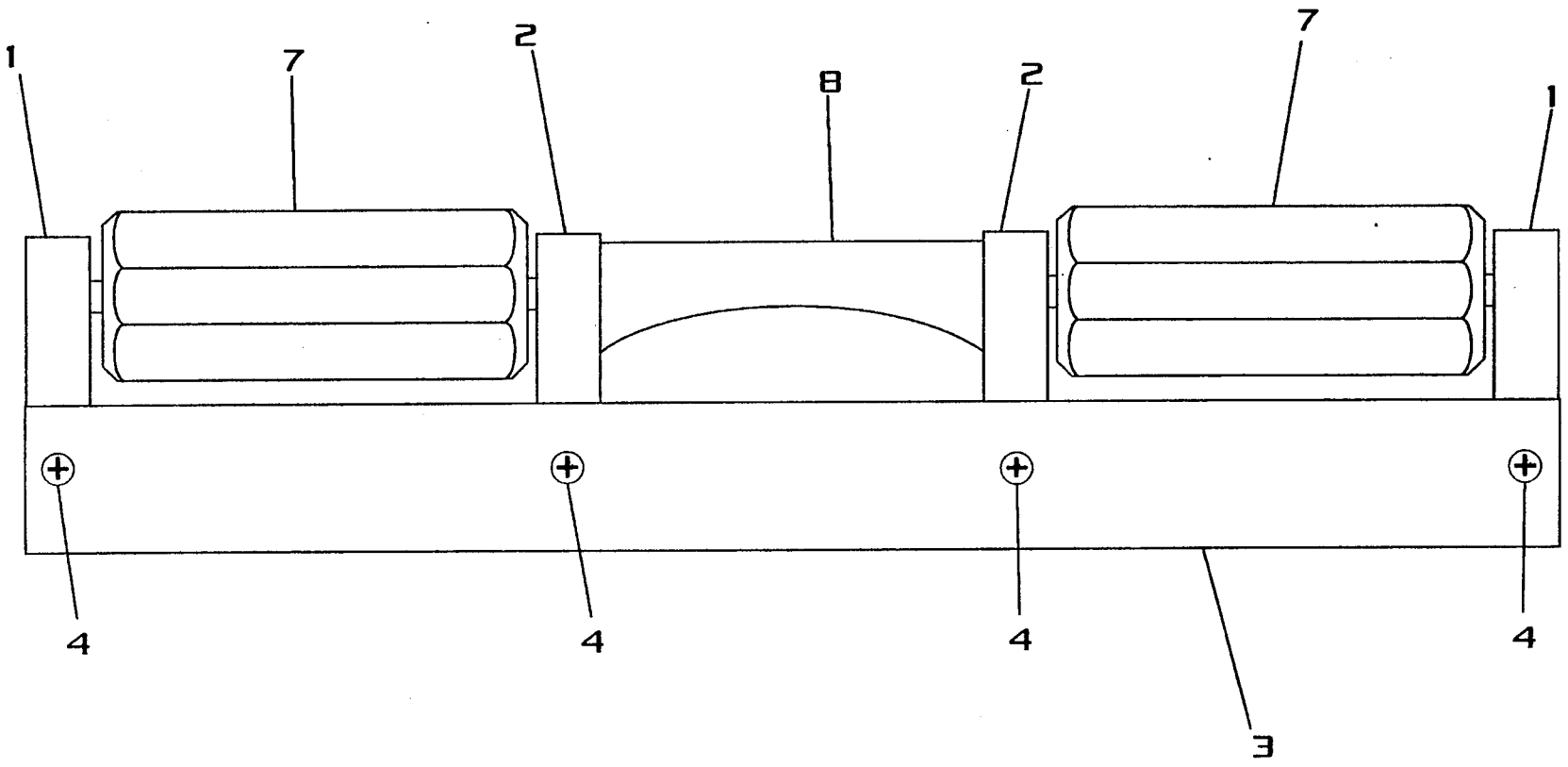
FIG. 1 represents a side view of the preferred embodiment including the base and rollers.
Figure 2:
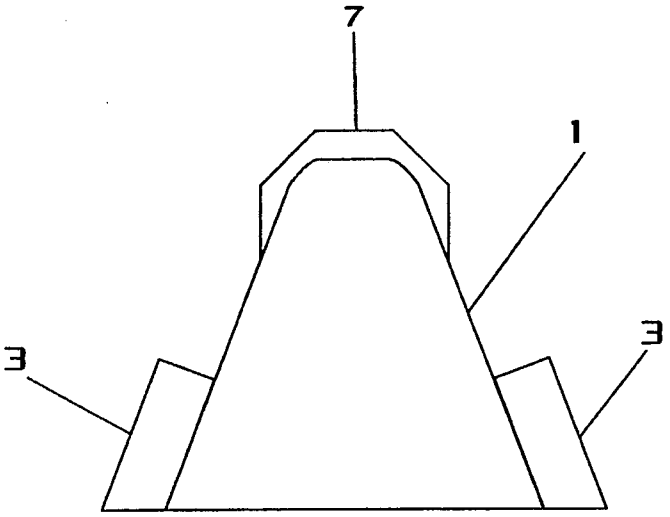
FIG. 2 represents the closed end of each of the support structures of the device.
Figure 3:
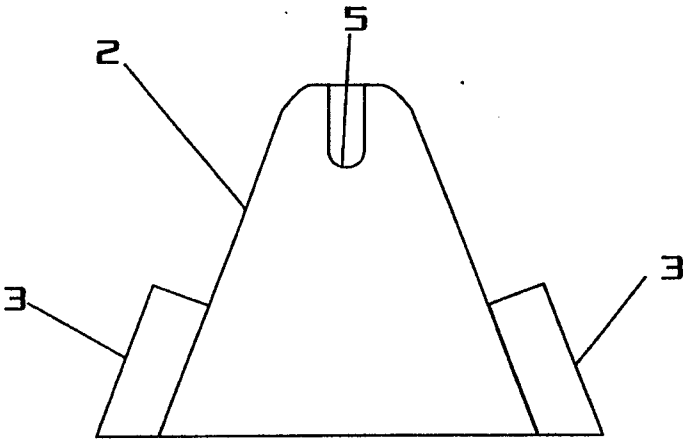
FIG. 3 represents the open inner facing of the support structures of the device.
Figure 4B:
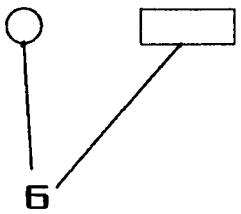
FIGS. 4*a* and 4*b* represent the end view of a roller and the connecting pin and structure.
Figure 4A:
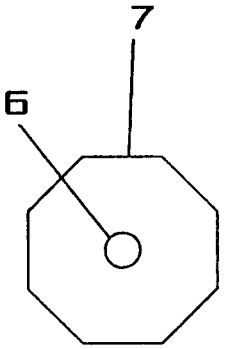
Figure 5:
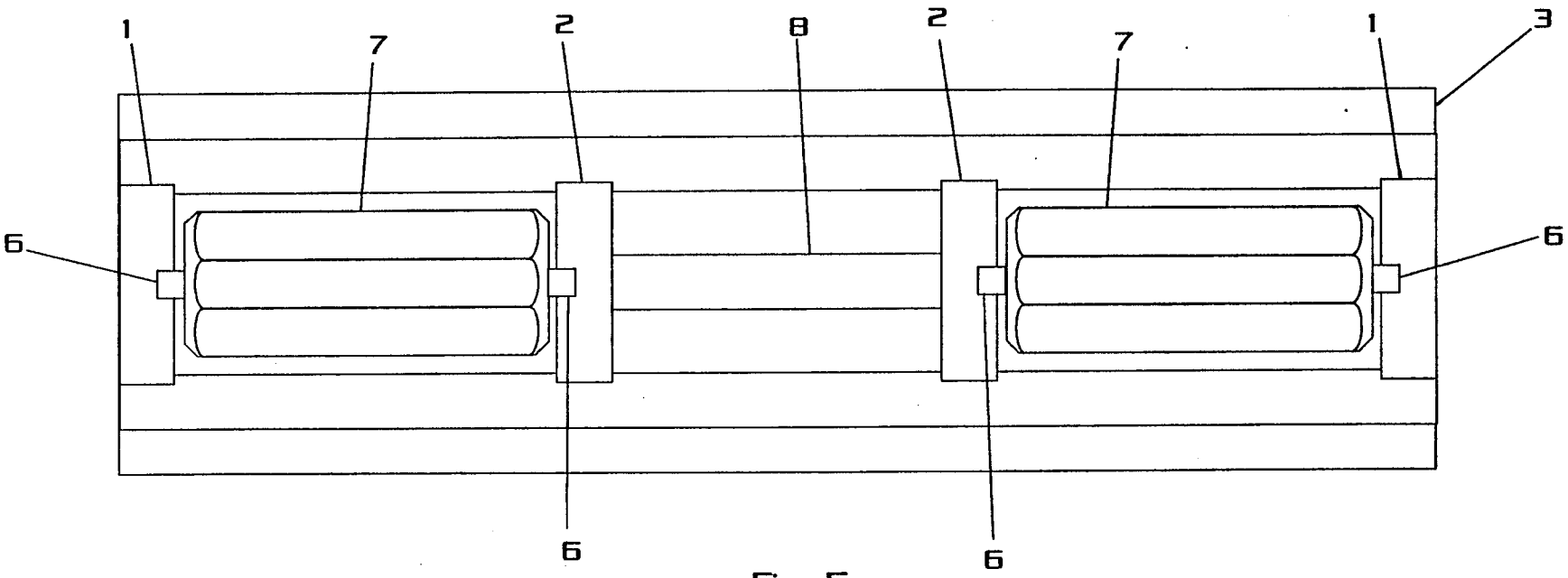
FIG. 5 represents a top view of the preferred embodiment.

The present invention includes two end support structures 1 which are triangular in shape (see FIG. 2) therefore providing a sturdy base structure. Two internal support structures 2, also triangular, and identical in shape and size are attached to the two end supports with two side rectangular connecting pieces 3 and are rigidly secured with four countersunk wood screws 4. The end supports each have a notched inner upper surface 5 to provide for the reception of the cold rolled pins 6 which are attached in the center of the rollers 7 and provide for rotational movement within the notched area 5. The inner support structures also have the same notched section 5 as the end supports and function accordingly. The rollers 7 with their centrally attached pins 6 are mounted within each of the two sets of opposing inner and end supports and are freely removable and rotatable. Mounted between the inner support structures 2 is a handle/support piece 8 which has a flat upper surface and a curved lower surface. The rollers 7 are octagonal in shape as can be seen in FIG. 4*a* with tapered ends for comfort and safety.

The preferred embodiment has the support structures and connecting pieces made of oak or any other suitable hardwood and the rollers are made of soapstone blocks. The rollers being made of soapstone or an equivalent heat absorbing material provides the catalyst for the present invention. The soapstone allows for the easy absorption of direct thermal transfer. Soapstone also known as steatite is a soft rock composed of mostly the mineral talc. It feels soapy or oily and varies from white to gray and grayish green. Soapstone has many industrial uses. It makes a good insulator and can be easily cut into various shapes. Because soapstone is not affected by high temperatures or acid, it can easily be heated in hot water, sunlight etc., and sustain temperature for an extended period of time.

To use the above cited device one simply removes the two soapstone rollers 7, places the rollers in hot water, in the sunlight or on a stove/range and in a matter of minutes the rollers will reach the desired temperature—that which feels comfortable to the user without burning. The rollers are then placed back into the notched sections 5 of the wooden support structures 1 and 2. The device can then be placed in any desired location with the users feet being placed upon the rollers and repeating a back and forth motion to massage the feet as desired.

The instant invention as disclosed should not be limited to the exact embodiment enclosed and can be practiced in many differing ways and with many different materials without departing from the scope of the instant invention. The device can be of any desired dimensions, differing shaped support structures, be made of plastic or other equivalent materials and the rollers made of any similar material. The device can have a single roller or more than two rollers or have various differing configurations e.g. multiple rollers in parallel. The rollers themselves need not be octagonal but can be various shapes with various textured/scored/beveled/-not beveled patterns. The rollers also may be of differing colors. The base may further be made entirely of soapstone. The rollers can be heated in any known thermal transfer method and in an additional embodiment with the pins being replaced by nonconductive materials (i.e. teflon or plastic) may be heated in liquid in the microwave.

We claim:

1. Apparatus for providing massage and heat to a foot or feet comprising:

a base member comprising external and internal support structures connected with a plurality of longitudinal connecting means;

said internal support structures having recessed receiving means;

at least one roller means having an extending pin from each end thereof connected to and rotatably mounted on said support structures within said receiving means;

handle means having a concave lower surface connected between said internal support structures;

wherein said roller means is made substantially of a solid block of soapstone, and wherein said at least one roller is removable from said receiving means, heatable and replaceable wherein said at least one roller is free to rotate.

2. The apparatus as in claim 1, wherein said at least one roller is two or more rollers.

3. The apparatus as in claim 1, wherein said base and support structures are made of a hardwood material.

4. The apparatus as in claim 3, wherein said at least one roller is two or more rollers.

5. The apparatus as in claim 1, wherein said pins are made of a conductive material.

6. The apparatus as in claim 5, wherein said at least one roller is two or more rollers.

7. The apparatus as in claim 1, wherein said pins are made of a non-conductive material.

8. Apparatus for providing massage and heat to a foot or feet comprising:

a hardwood material base member comprising external and internal support structures connected with a plurality of longitudinal connecting means;

said internal support structures having recessed receiving means;

at least one roller made substantially of a solid block of soapstone having an extending pin from each end thereof connected to and rotatably mounted on said support structures within said receiving means; wooden handle means connected between said internal support structures, and wherein said at least one roller is removable from said receiving means, heatable and replaceable and wherein said at least one roller is free to rotate.

9. The apparatus as in claim 8, wherein said extending pins are made of a conductive material.

10. The apparatus as in claim 8, wherein said extending pins are made of a non-conductive material.

11. The apparatus as in claim 8, wherein said at least one roller is two or more rollers.

12. The apparatus as in claim 8, wherein said at least one roller is octagonal.

13. The apparatus as in claim 12, wherein said at least one roller is textured.

* * * * *